US009842672B2

(12) United States Patent
Jiang et al.

(10) Patent No.: US 9,842,672 B2
(45) Date of Patent: Dec. 12, 2017

(54) LAN CABLE WITH PVC CROSS-FILLER

(75) Inventors: Qibo Jiang, Ephrata, PA (US); Joshua Keller, Mechanicsburg, PA (US); Paul Kroushl, Lancaster, PA (US)

(73) Assignee: NEXANS, Paris (FR)

( * ) Notice: Subject to any disclaimer, the term of this patent is extended or adjusted under 35 U.S.C. 154(b) by 851 days.

(21) Appl. No.: 13/398,106

(22) Filed: Feb. 16, 2012

(65) Prior Publication Data

US 2013/0213686 A1 Aug. 22, 2013

(51) Int. Cl.
*H01B 7/00* (2006.01)
*H01B 7/295* (2006.01)
*H01B 11/06* (2006.01)

(52) U.S. Cl.
CPC ..... *H01B 7/295* (2013.01); *H01B 11/06* (2013.01)

(58) Field of Classification Search
CPC ..... H01B 7/00–7/34
USPC ..... 174/110 R–110 F, 113 R, 120 R, 120 SR, 174/120 AR, 121 R, 121 AR
See application file for complete search history.

(56) References Cited

U.S. PATENT DOCUMENTS 3,944,717 A 3/1976 Hacker et al.
4,670,494 A * 6/1987 Semenza, Jr. ..... 524/141
4,892,683 A * 1/1990 Naseem ..... 252/609
5,036,121 A * 7/1991 Coaker et al. ..... 524/100
5,460,885 A 10/1995 Chu-Ba
5,600,097 A 2/1997 Bleich et al.
5,841,072 A 11/1998 Gagnon et al.
5,886,072 A * 3/1999 Linsky et al. ..... 524/145
5,936,205 A * 8/1999 Newmoyer ..... 174/113 R
6,008,283 A 12/1999 Rose et al.
6,043,312 A * 3/2000 Fagher et al. ..... 524/523
6,150,612 A * 11/2000 Grandy et al. ..... 174/113 C
6,211,467 B1 4/2001 Berelsman et al.
6,259,031 B1 7/2001 Totland et al.
6,492,453 B1 * 12/2002 Ebrahimian et al. ..... 524/447
6,608,142 B1 * 8/2003 Weng et al. ..... 525/214
6,998,537 B2 * 2/2006 Clark et al. ..... 174/113 R
7,196,271 B2 * 3/2007 Cornibert et al. ..... 174/113 C
7,329,815 B2 * 2/2008 Kenny et al. ..... 174/113 C
2004/0216914 A1 * 11/2004 Vexler et al. ..... 174/121 A
2006/0113106 A1 * 6/2006 Vexler et al. ..... 174/120 R
2006/0124344 A1 6/2006 Clark et al.
2006/0137894 A1 6/2006 Cusson et al.
2006/0151758 A1 * 7/2006 Reyes ..... 252/601
2007/0078209 A1 * 4/2007 Jozokos et al. ..... 524/430
(Continued)

FOREIGN PATENT DOCUMENTS

EP 0742565 11/1996
EP 1306859 5/2003
(Continued)

OTHER PUBLICATIONS

European Search Report dated 2013.

*Primary Examiner* — William H Mayo, III
(74) *Attorney, Agent, or Firm* — Sofer & Haroun, LLP

(57) ABSTRACT

A communications cable includes a jacket and a plurality of twisted pairs, each twisted pair having two insulated conductors twisted around one another. A cross-filler is arranged between the twisted pairs, where the cross filler is constructed of a PVC formulation using a halogenated plasticizer as the primary plasticizer and having a dissipation factor below 0.01 at frequencies between 100 MHz to 500 MHz.

18 Claims, 3 Drawing Sheets

(56) References Cited

U.S. PATENT DOCUMENTS

| | | | | |
|---|---|---|---|---|
| 2008/0226240 | A1 | 9/2008 | Mumm | |
| 2008/0264670 | A1* | 10/2008 | Glew | 174/113 C |
| 2009/0022462 | A1* | 1/2009 | Papazoglou et al. | 385/123 |
| 2009/0069480 | A1* | 3/2009 | Zangara et al. | 524/405 |
| 2011/0198108 | A1 | 8/2011 | Abu-Ali et al. | |
| 2011/0284287 | A1* | 11/2011 | Glew | 174/99 R |

FOREIGN PATENT DOCUMENTS

| | | | | |
|---|---|---|---|---|
| EP | 1607985 | | 12/2005 | |
| WO | 9857920 | | 12/1998 | |
| WO | 9954889 | | 10/1999 | |
| WO | WO99/54889 | * | 10/1999 | H01B 11/02 |
| WO | 0008656 | | 2/2000 | |
| WO | 0188930 | | 11/2001 | |
| WO | 2011100584 | | 8/2011 | |

* cited by examiner

LAN CABLE WITH PVC CROSS-FILLER

BACKGROUND

Field of the Invention

This application relates to communication cables. More particularly, this application relates to network cable construction.

Description of Related Art

Communication cables are broadly grouped into two arrangements, fiber optic cables and metal conductor cables, each of which has its own unique set of construction parameters that affect the quality of the communication signals carried therethrough.

Regarding metal conductor cables, one typical arrangement is the LAN (Local Area Network) cable that is usually constructed of four pairs of twisted insulated copper conductors encased within a jacket. Other larger cables may employ ore pairs of conductors.

In this typical four pair LAN cable construction, in addition to the outer jacket, each of the eight primary conductors are individually coated with an insulation layer. Among the other components, LAN cables often include a tape or various extruded shapes including cross-fillers to separate the twisted pairs for better NEXT (Near End Cross Talk) performance.

In each case, aside from electrical performance considerations, there are certain flammability performance tests that need to be met. One such crucial test is the NFPA (National Fire Protection Association) 262 flame test (or UL 910), which is a standard method of testing for flame travel and smoke generation for testing wires and cables that may be installed in air-handling spaces such as budding ductwork.

In this context, FEP (Fluorinated Ethylene Polymer) resin, thanks to its outstanding electrical and flame performance, is a typical material choice for the LAN cable application. Aside from its use as the insulation on the primary conductors of the twisted pairs, FEP is also currently the ideal material choice for tapes or various extruded shapes including cross fillers as it has excellent electrical properties and good flame and smoke performance.

Alternative prior art arrangements have used mixtures of LDPE and VLDPE (Low Density and Very Low Density Polyethylene) with significant quantities of flame retardant fillers blended into the polymer composition. Such highly filled LDPE and/or VLDPE olefin blends are used for cross fillers to reduce cost of the LAN cable. However, even when highly filled with flame retardant fillers, such LDPE and VLDPE polymers still exhibit inferior smoke and flame resistance properties relative to the FEP.

Other polymers exist such as PVC (Poly-Vinyl Chloride) with fire retardant fillers (e.g. FRPVC), however, prior art constructions do not use PVC for CAT 6 LAN tapes or cross fillers to separate twisted pairs because PVC without plasticizing additives tend to be too rigid for cable applications. When plasticizing additives are incorporated into the PVC, they tend to degrade the electrical properties of the PVC causing too much signal attenuation to be useful in most CAT 6 LAN cable applications. For example, the commonly used plasticizers in PVC insulation for wire and cable arrangements are ester based plasticizers which can have a negative effect on the dissipation factor of the final PVC compound.

Generally, there is a dissipation of electrical energy, caused by the presence of dielectric material in close proximity to the wire. The dissipation factor of a dielectric material is a measure of the power loss rate caused by said material. Certain polymers have better (lower) dissipation factors than others. Likewise, the same polymer may exhibit a different dissipation factor depending on different formulations of that polymer (e.g. different additives, flame retardants, processing agents etc incorporated into the polymer).

As shown in prior art FIG. 1, over various frequency ranges, ester based plasticizers (used at 50 phr in PVC) still result in the PVC exhibiting dissipation loss factors in excess of 0.01 at frequencies between 100 MHz to 500 MHz.

OBJECTS AND SUMMARY

The present arrangement, overcomes the drawbacks of the prior art arrangements, and employs a PVC cross filler in a LAN cable, where the PVC formulation of fillers and plasticizers is such that the PVC is rendered sufficiently flexible for use as a cross filler, while also simultaneously exhibiting good fire and smoke resistance properties as well as acceptable electrical properties.

For example, among other features, the present arrangement employs halogenated phthalates, such as brominated phthalate ester plasticizers, which, at equal loading levels amounts relative to the more common prior art ester based plasticizers, yield PVC formulations with significantly lower dissipation factors.

To this end a communications cable includes a jacket and a plurality of twisted pairs, each twisted pair having two insulated conductors twisted around one another. A cross-filler is arranged between the twisted pairs, where the cross filler is constructed of a PVC formulation using a halogenated plasticizer as the primary plasticizer and having a dissipation factor below 0.01 at frequencies between 100 MHz to 500 MHz.

BRIEF DESCRIPTION OF THE DRAWINGS

The present invention can be best understood through the following description and accompanying drawings, wherein.

DETAILED DESCRIPTION

Figure 2:
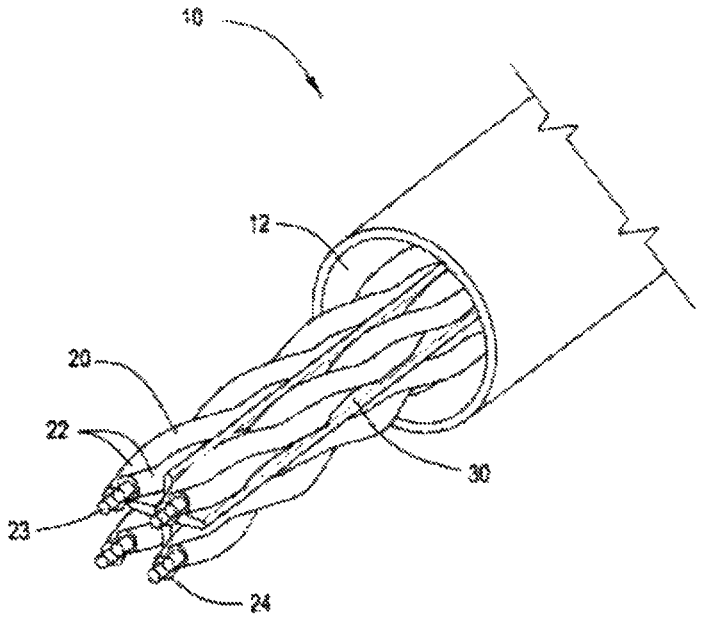
FIG. 2 shows a LAN cable with a cross-filler according to the present arrangement.

In one embodiment as illustrated in FIG. 2, a LAN (Local Area Network) cable 10 is shown, such as a CAT 6 CMP (Plenum) UTP LAN cable (Category 6 250 MHz—Unshielded Twisted Pair). For the purposes of illustration, the salient features of the present arrangement are described in the context of a CAT 6 type LAN cable, however, the invention is not limited in this respect. Other cables that are required to meet certain flame test specifications may also employ the present technology.

Figure 1:
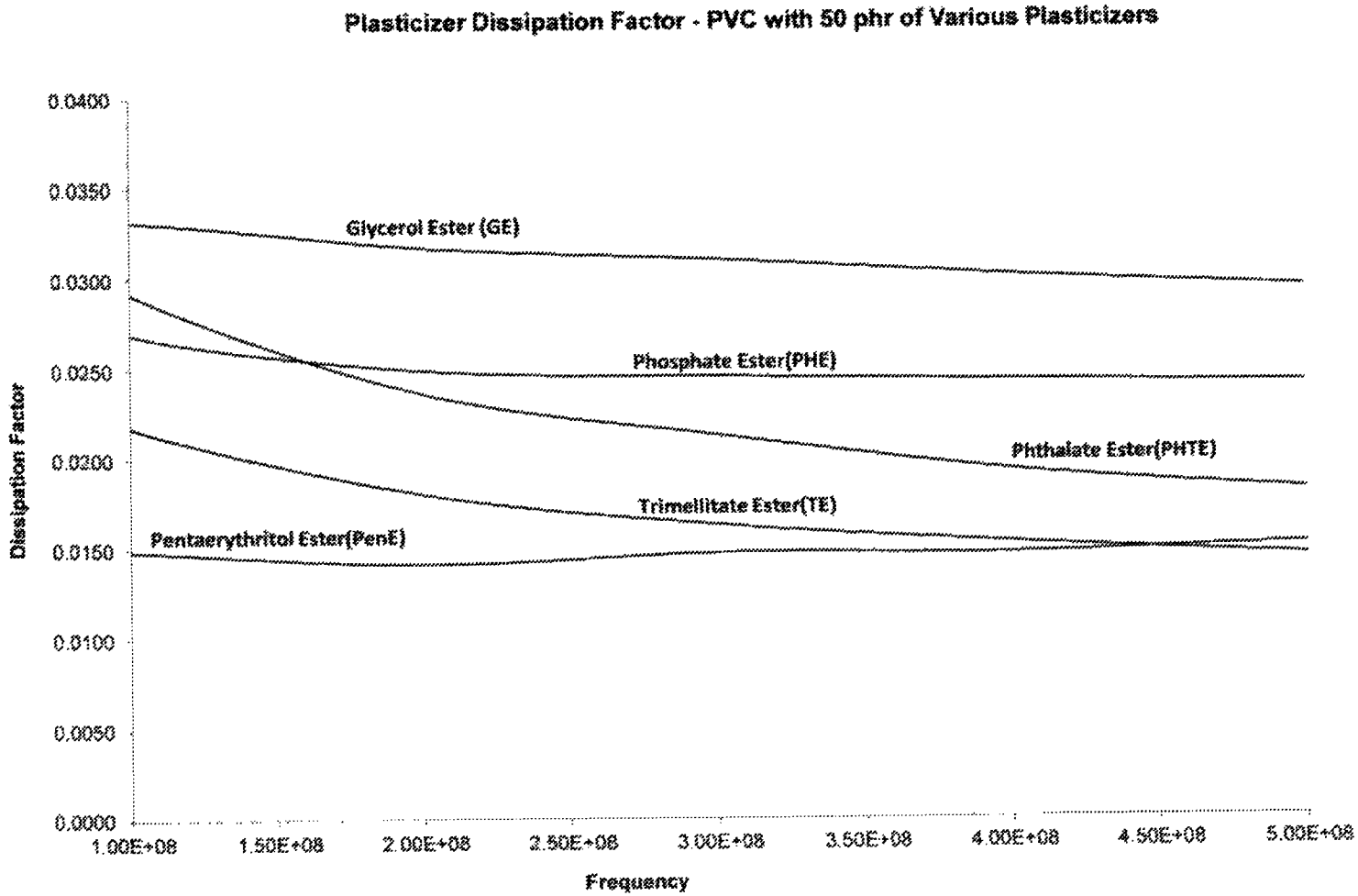
FIG. 1 is a prior art dissipation factor chart of prior art PVC formulations using non-halogenated plasticizers as the primary plasticizers.

As shown in FIG. 2, LAN cable 10 has a jacket 12 constructed for example from FRPVC (Flame Retardant Poly-Vinyl Chloride). Within jacket 12 there are four twisted pairs 20. Each twisted pair is formed of two primary conductors 22 twisted around one another. As shown in FIG. 1 primary conductors 22 are typically made from a copper wire conductor 23 covered with an insulation layer 24. As noted above, for exemplary purposes, cable 10 is a four pair LAN cable, but it is understood that the salient features of the present arrangement could be used on cables having more or fewer pairs 20.

In the present arrangement, the polymer material used for insulation layers 24 may be made from FEP (Fluorinated Ethylene Polymer), FRPP (Flame Resistant Poly Propylene) or other polymers. Optionally, some of the insulation layers 24 on some of the pairs 20 may be made from a first polymer such as FEP, with other insulation layers 24 on some of the pairs 20 being made from FR olefins such as FRPP in order to balance flame/smoke properties, mechanical properties and costs. It is understood that any selection of insulation material for insulation layers 24 on pairs 20 is within the contemplation of the present invention.

For example, in one arrangement, insulation layer 24 on two twisted pairs 20 are made from a flame resistant olefin composition, such as FRPP, and the other two insulation layers 24 on the remaining two twisted pairs 20 are made from FEP. In other examples, all four pairs 20 may be made using FEP; 3 pairs 20 from FEP with one pair 20 using FRPP; 3 pairs 20 from FRPP with one pair 20 using FEP; and all four pairs 20 made using FRPP.

Ideally, FEP usage is limited due to its expense, but it is used on at least some of the pairs 20 owing to its superior flame and smoke properties as well as its good electrical properties. The construction of the present cable 10 and other components thereof allow for an advantageous reduction in the number of pairs 20 insulated with FEP, while still maintaining the required plenum and CAT 6 ratings as discussed in more detail below.

As illustrated in FIG. 2, in addition to the twisted pairs 20, cable 10 also has a cross filler 30 made from FRPVC. As noted above, in high performance CAT 6 cables, tapes or other extruded shapes such as cross fillers are often required to reduce cross-talk between the different pairs 20 within cable 10. As noted in the background FEP and highly flame retardant polyolefins have been used in prior art arrangements for making cross-fillers. FRPVC is not typically used because the commonly used non-halogenated plasticizing agents render the FRPVC with poor electrical properties (i.e. high dissipation factors).

For the purposes of illustration, cross filler 30 is used to show the dividing element between pairs 20 in cable 10. However, it is understood that the shape of this divider/cross filler is only for the purposes of illustrating the salient features of the present arrangement. Cross filler 30 may be alternatively formed as a tape of filler/divider or other non-crossed shapes provided is made using the following described formulation.

In the present arrangement, and in accordance with one embodiment, cross filler 30 is constructed of PVC using a halogenated ester plasticizer as the primary (in this case only) plasticizer, with the PVC formulation having a dissipation factor lower than 0.01 at frequencies between 100 MHz and 500 MHz as described in more detail below.

It is noted that PVC may come in thousands of different formulations, including the basic polymer structure (Molecular Weight), the plasticizers used, the fillers etc. . . . . In accordance with one embodiment, one exemplary PVC formulation is as follows:

| | | |
|---|---|---|
| PVC | 100.0 | phr (phr = parts per hundred pounds of resin) |
| FRP 45 Brominated DOP | 60.0 | phr |
| Aluminum Trihydrate | 50.0 | phr |
| Huber HPSS (basic zinc molybdate) | 10.0 | phr |
| Antimony Trioxide | 2.0 | phr |
| Ferro RC 641P Ca/Zn Stabilizer | 6.0 | phr |
| Titanium dioxide | 0.5 | phr |
| OPE wax | 0.6 | phr |

From the above description, FRP 45 is the primary plasticizer and can be described chemically as tetrabromo bis(2-ethylhexyl) phthalate.

In the above example, Brominated DOP is the only plasticizer used and, at 60 phr to 100 phr PVC resin it is a substantial component, with the remaining components being fire retardant fillers, stabilizers, colorants, processing lubricants, and stabilizers.

It is noted that the PVC may be blended with CPVC (Chlorinated PVC) or CPE (chlorinated polyethylene) to achieve additional fire retardant dualities.

The above example is intended as one exemplary PVC formulation for cross filler 30. However, it is understood that modifications can be made provided that the halogenated ester plasticizer remains the primary plasticizer, meaning that the halogenated ester plasticizer is the majority component of the plasticizer(s) in the polymer composition. For example, in other embodiments, the following PVC formulation (range of component parts) may be used:

| | | |
|---|---|---|
| PVC | 0-100 phr | Resin |
| Chlorinated PE | 0-100 phr | Resin or plasticizer depending on chlorine content |
| Halogenated Ester Plasticizer | 30-150 phr | Plasticizer + FR |
| Non-Halogenated Plasticizer | <20 phr | Plasticizer |
| Metal Hydrate Flame Retardant(s) | 1-300 phr | FR + SS |
| Molybdenum FR/SS | 0.1-50 phr | FR + SS |
| Zinc FR/SS | 0.1-50 phr | FR + SS |
| Antimony Trioxide | 0.1-50 phr | FR |
| Stabilizer | 0.1-20 phr | Stabilizes compound |

(FR = Flame Retardant - SS = Smoke Suppressant)

The halogenated plasticizers may include, but are not limited to: brominated phthalate esters; chlorinated phthalate esters; brominated trimellitate esters; chlorinated trimellitate esters; brominated paraffins; chlorinated paraffins; and chlorinated polyethylene (CPE).

The non-halogenated plasticizer may include, but is not limited to phthalate esters, trimellitate esters, pentaerythritol esters, phosphate esters, aliphatic dicarboxylic add esters, sulfonic add esters, sulfamides, citric acid esters, epoxidized fatty add esters, benzoic add esters; and polymeric plasticizers systems containing but not limited to monomers such as adipic add, sebacic add, azeleic add, and commercially available compatible polymers containing acrylate, acetate, nitrile, urethane, or polyether ester functionality.

The metal hydrate flame retardant may include, but is not limited to: aluminum trihydrate, boehmite, magnesium dihydroxide, magnesium carbonate, zinc borate, metal hydrates coated with a flame retardant or smoke suppressant; or combinations of two or more metal hydrates.

The PVC compound may have smoke suppressants or combinations of smoke suppressants containing one or more of the following elements: Mo, Zn, Sn, Cu, Fe, Si, B, P, C, or N.

The above described PVC formulation has excellent flame and smoke performance based on the fillers and halogenated plasticizer as well as good electrical properties to reduce NEXT (Near End Cross Talk) without affecting the cable's insertion loss performance.

Moreover, although the preferred PVC crossfiller formulation in general tends to be stiffer than LDPE, or VLDPE, it is more flexible than crossfillers based on FEP. The final cable 10 manufactured with the above formulation for PVC cross filler 30 exhibits flexibility characteristics similar to those of cables manufactured pith the FR olefin cross fillers.

Figure 3:
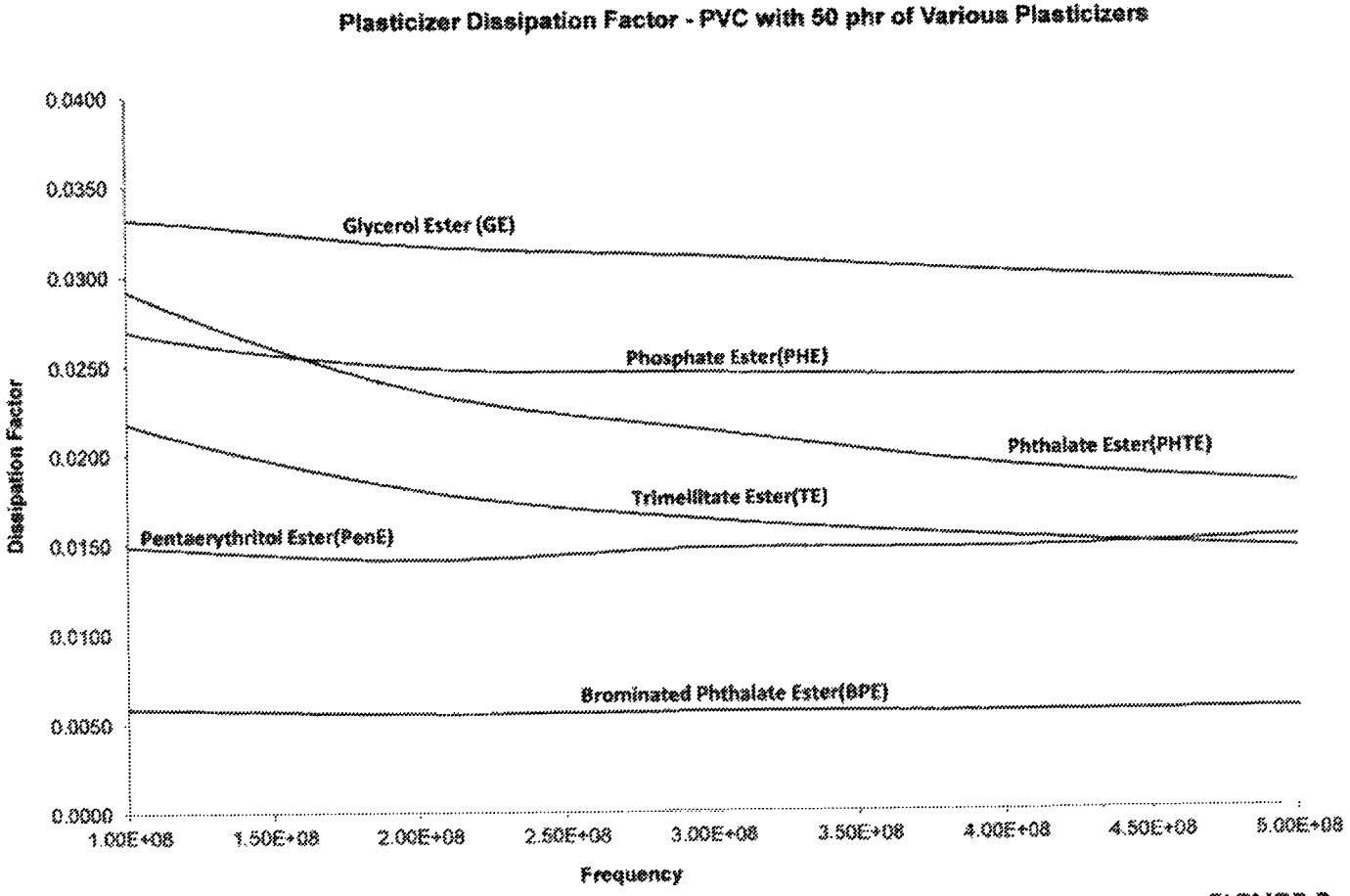
FIG. 3 is a dissipation factor chart comparing prior art PVC formulations using non-halogenated plasticizers as the primary plasticizers to the present PVC formulations using halogenated plasticizers as the primary plasticizers.

The present arrangement has provided the unexpected result that the use of very high quantities of halogenated ester plasticizers and the near or complete removal of non-halogenated plasticizers actually lead not only to the required fire resistant properties, but also to sufficient flexibility while yielding a dissipation factor value for the PVC formulation below 0.01 at frequencies between 100 MHz and 500 MHz. See for example FIG. 3 showing a comparison of the dissipation factors of PVC using prior art plasticizers versus brominated phthalate ester (all at 50 phr).

To show that the above formulations of PVC are not only good for producing cross filler 30 with good electrical properties they were tested against prior art cross fillers for fire and smoke properties to show that it provides comparable prior flame and smoke properties to FEP and better than other FR olefin formulations (e.g. FRPE, FRPP, etc. . . . )

Turning to test results for the present arrangement, the above described NFPA 262 flame test is applied to cables, such as cable 10, intended for use within buildings inside of ducts, plenums, or other spaces used for environmental air distribution. Any cable used in these areas must be "plenum rated" in order to be installed without conduit. One such plenum rating test is the NFPA 262 test. In order to pass the NFPA 262 test, these cables must have outstanding resistance to flame spread and generate low levels of smoke during combustion. As noted above, flame spread and smoke generation is directly related to the use of jacketing on cable 10, and in particular the insulation used on twisted pairs 20. Because of the need to use low smoke insulation and jacketing materials, these plenum rated cables are the highest in cost of the three major premise data communications cable types specified by the NEC (National Electric Code).

The NFPA 262 flame test uses a test apparatus called a Steiner Tunnel. This chamber is 25' long by 18 inches wide by 12 inches high. An 11.25 inch wide tray is loaded with a single layer of cable, such as cable 10 placed side to side against each other so that the width of the tray is filled. The cable is then exposed to a 300,000 btu flame for 20 minutes. During the course of the test, the flame must not propagate more than 5 feet, the peak smoke must not exceed a value of 0.15 (log Io/I), and the average smoke value must not exceed 0.15 (log Io/I). It is noted that log Io/I refers to the optical density where I is the intensity of light at a specified wavelength $\lambda$ that has passed through a sample (transmitted light intensity) and $I_0$ is the intensity of the light before it enters the sample or incident light intensity (or power). If the cable is tested twice and meets all three criteria after each test, it is deemed to have passed the test.

To show the effectiveness of cable 10, cross filler 30 made from the present PVC formulation (using halogenated phthalate ester plasticizer) was tested against a prior art cross filler made from a FR olefin based on a blend of LDPE and VLDPE containing a proprietary flame retardant system with a specific gravity of 1.63.

The following table 1 shows the results of the NFPA 262 test:

TABLE 1

NFPA 262 Steiner Tunnel Data FR Olefin Cross filler Technology vs present PVC Cross filler composition Average of two burns - 0.015" wall jacket compound

| | Flame Spread | Peak Smoke | Avg. Smoke |
|---|---|---|---|
| FR Olefin Technology | 4.8' | 0.47 | 0.13 |
| New PVC Technology | 2.0' | 0.31 | 0.12 |
| NFPA 262 Requirements | | | |
| Flame Spread | | 5.0' or less | |
| Peak Smoke | | 0.50 or less | |
| Average Smoke | | 0.15 or less | |

The above test was performed using the present cable 10 arrangement with a cross filler, using FEP pairs 20 and 2 FRPP pairs 20 with a 15 mil overall jacket of a PVC based plenum rated jacket compound.

As seen from the above Table 1, PVC cross filler 30 exhibited improved performance in all test criteria versus a similarly arranged FR olefin cross filler, while being significantly less costly than either an FR olefin cross filler or an FEP cross filler. Such a cross filler 30 may be used in a cable 10, in place of either FR olefin cross fillers to provide better flame, smoke, or cost performance or in place of FEP cross fillers to save significant costs while maintaining the comparable flame and smoke performance. In fact, because the improved cross filler 30 passes the NFPA standard by such a margin, other exemplary designs of the present cable 10 using only 1 FEP pair 20 or even no FEP pairs 20 (all FRPP) would likely also pass the NFPA 262 fire and smoke standards.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A communications cable, said cable comprising:

a jacket;

a plurality of twisted pairs, each twisted pair having two insulated conductors twisted around one another; and a divider arranged between said twisted pairs, wherein said divider is constructed of a PVC formulation having a plurality of constituent parts thereof, including at least a halogenated plasticizer as the primary plasticizer, where the totality of the constituent parts of said PVC formulation are selected and combined such that the extruded divider exhibits a dissipation factor below 0.01 at frequencies between 100 MHz and 500 MHZ.

2. The communication cable as claimed in claim 1, wherein said jacket is made from FRPVC.

3. The communication cable as claimed in claim 1, wherein said cable has four twisted pairs.

4. The communication cable as claimed in claim 3, wherein all four twisted pairs are insulated using FRPP (Fire resistant Poly Propylene) or other flame retardant olefin.

5. The communication cable as claimed in claim 3, wherein three of said twisted pairs are insulated using FRPP (Fire resistant Poly Propylene) or other flame retardant olefin and one of said twisted pairs is insulated using FEP (Fluorinated Ethylene Polymer) or other fluoropolymer.

6. The communication cable as claimed in claim 3, wherein two of said twisted pairs are insulated using FRPP (Fire resistant Poly Propylene) or other flame retardant olefin and two of said twisted pairs are insulated using FEP (Fluorinated Ethylene Polymer) or other fluoropolymer.

7. The communication cable as claimed in claim 3, wherein one of said twisted pairs is insulated using FRPP (Fire resistant Poly Propylene) or other flame retardant olefin and three of said twisted pairs are insulated using FEP (Fluorinated Ethylene Polymer) or other fluoropolymer.

8. The communication cable as claimed in claim 3, wherein all four twisted pairs are insulated using FEP (Fluorinated Ethylene Polymer) or fluoropolymer.

9. The communication cable as claimed in claim 1, wherein CPVC (chlorinated PVC) is blended with PVC in said PVC formulation.

10. The communication cable as claimed in claim 1, wherein said halogenated plasticizer is a brominated phthalate ester.

11. The communication cable as claimed in claim 10, wherein said brominated phthalate ester is included in said PVC composition at substantially 60 phr.

12. The communication cable as claimed in claim 1, wherein said halogenated plasticizer in said PVC formulation of said divider is included in the amount of 0.1-150 phr and is selected from one or more of the group consisting of brominated phthalate esters, chlorinated phthalate esters, brominated trimellitate esters, chlorinated trimellitate esters, brominated paraffins, chlorinated paraffins, and chlorinated polyethylene (CPE).

13. The communication cable as claimed in claim 12, wherein said PVC formulation of said divider further comprises a non-halogenated plasticizer, of less than 20 phr and less than the amount of said halogenated plasticizer, and is selected from one or more of the group consisting of phthalate esters, trimellitate esters, pentaerythritol esters, phosphate esters, aliphatic dicarboxylic acid esters, sulfonic acid esters, sulfamides, citric acid esters, epoxidized fatty acid esters, benzoic acid esters, and polymeric plasticizers systems containing but not limited to monomers such as adipic acid, sebacic acid, azeleic acid, and commercially available compatible polymers containing acrylate, acetate, nitrile, urethane, or poly ether ester functionality.

14. The communication cable as claimed in claim 1, wherein said PVC formulation of said divider further comprises 0.1-300 phr of a metal hydrate flame retardant filler selected from one or more of the group consisting of but not limited to aluminum trihydrate, boehmite, magnesium dihydroxide, magnesium carbonate, zinc borate, metal hydrates coated with a flame retardant or smoke suppressant, or combinations of two or more metal hydrates.

15. The communication cable as claimed in claim 1, wherein said PVC formulation of said divider further comprises 0.1-100 phr of a smoke suppressant or combinations of smoke suppressants selected from one or more of the group consisting of Mo, Zn, Sn, Cu, Fe, Si, B, P, C, and N.

16. The communication cable as claimed in claim 1, wherein said cable is constructed to meet the requirements of NFPA 262 fire and smoke test.

17. The communication cable as claimed in claim 1, wherein said cable is constructed to meet the requirements of CAT 6 CMP.

18. The communication cable as claimed in claim 1, wherein said divider is selected from the group consisting of a tape, and extruded thermoplastic or thermoset twisted pair separator and an extruded thermoplastic or thermoset cross filler.

* * * * *